US009776196B2

(12) United States Patent
Yu

(10) Patent No.: US 9,776,196 B2
(45) Date of Patent: Oct. 3, 2017

(54) PUSH-BUTTON SWITCHING STRUCTURE FOR HAND-HELD SHOWER HEAD

(71) Applicant: Sinyu Technology (Fujian) Co., Ltd., Zhangzhou (CN)

(72) Inventor: Zhangjun Yu, Longhai (CN)

(73) Assignee: Sinyu Technology (Fujian) Co., Ltd., Zhangzhou (CN)

( * ) Notice: Subject to any disclaimer, the term of this patent is extended or adjusted under 35 U.S.C. 154(b) by 0 days.

(21) Appl. No.: 15/320,756

(22) PCT Filed: Oct. 9, 2014

(86) PCT No.: PCT/CN2014/088197

§ 371 (c)(1),
(2) Date: Dec. 21, 2016

(87) PCT Pub. No.: WO2015/196618

PCT Pub. Date: Dec. 30, 2015

(65) Prior Publication Data

US 2017/0136473 A1 May 18, 2017

(30) Foreign Application Priority Data

Jun. 27, 2014 (CN) ..... 2014 1 0296291

(51) Int. Cl.

| | |
|---|---|
| ***B05B 1/18*** | (2006.01) |
| ***B05B 1/16*** | (2006.01) |
| ***B05B 12/00*** | (2006.01) |
| *B05B 15/06* | (2006.01) |

(52) U.S. Cl.
CPC ..... *B05B 1/1636* (2013.01); *B05B 1/1663* (2013.01); *B05B 1/18* (2013.01); *B05B 12/002* (2013.01); *B05B 15/061* (2013.01)

(58) Field of Classification Search
CPC ..... B05B 1/18; B05B 1/1636; B05B 1/1663; B05B 12/002; B05B 15/061
USPC ..... 239/443, 447, 448, 449, 525
See application file for complete search history.

(56) References Cited

U.S. PATENT DOCUMENTS

| | | | | |
|---|---|---|---|---|
| 5,433,384 A * | 7/1995 | Chan | B05B 1/1636 | 239/239 |
| 8,177,147 B2 * | 5/2012 | Engel | B05B 1/1654 | 239/393 |
| 8,276,833 B2 * | 10/2012 | Cheng | E03C 1/0409 | 239/436 |
| 8,573,512 B2 * | 11/2013 | Hu | B05B 1/1663 | 239/443 |
| 9,278,364 B2 * | 3/2016 | Zhou | B05B 1/1636 | |

(Continued)

*Primary Examiner* — Alexander Valvis

(57) ABSTRACT

Disclosed is a push-button switching structure for a hand-held shower head, including a water-dividing disc installed between a water inlet and a water outlet of a switching space and formed with a water-dividing hole, first bevel teeth, and a ratchet; a driver installed on the water-diving disc and having a bevelled groove and second bevel teeth to mate with the first bevel teeth; a worm having a bevelled reinforcing fillet to mate with the bevelled groove and a stopping part extending out of the switching space; a positioning pin pivoted in the switching space and having a pawl to mate with the ratchet; and a push button corresponding to the stopping part and mounted outside the switching space. This structure achieves the function of one push button controlling multiple water outputs.

6 Claims, 9 Drawing Sheets

(56) References Cited

U.S. PATENT DOCUMENTS

| | | | | |
|---|---|---|---|---|
| 2006/0261191 | A1* | 11/2006 | Chang | B05B 1/1663<br>239/525 |
| 2013/0015269 | A1* | 1/2013 | Zhou | B05B 1/1636<br>239/437 |
| 2014/0263756 | A1* | 9/2014 | Meehan | B05B 1/1627<br>239/446 |

* cited by examiner

PUSH-BUTTON SWITCHING STRUCTURE FOR HAND-HELD SHOWER HEAD

FIELD OF THE INVENTION

The present invention relates to a shower head structure, and more particularly to a push-button switching structure for a hand-held shower head.

BACKGROUND OF THE INVENTION

Nowadays, hand-held shower heads are the most commonly used shower tools. Hand-held shower heads on the markets are developed to have different spray modes by rotating a panel. It is required to switch a different spray mode with both hands. The operation is laborious, and it is inconvenient for use. Accordingly, the inventor of the present invention has devoted himself based on his many years of practical experiences to solve these problems and develop a push-button switching structure able to control different spray modes with a push button.

SUMMARY OF THE INVENTION

The primary object of the present invention is to provide a push-button switching structure for a hand-held shower head, with one push button to control multiple spray modes. The switching operation is more convenient.

In order to achieve the aforesaid object, the push-button switching structure for a hand-held shower head of the preset invention comprises a water route upper cover 1, a pre-compressed spring, a water-dividing disc, a driver, a separation spring, a worm, a positioning pin, a water route lower cover, and a push button. The water route upper cover and the water route lower cover are fastened together to form a switching space. The switching space is formed with a water inlet and a multi-sectioned water outlet and a switching hole. The water-dividing disc is mounted between the water inlet and the multi-sectioned water outlet in the switching space. The water-dividing disc is formed with a multi-sectioned water dividing hole corresponding to the multi-sectioned water outlet. The center of the water-dividing disc is formed with first bevel teeth. The edge of the water-dividing disc is formed with a ratchet. The pre-compressed spring is disposed between an inner wall of the switching space close to the water inlet and an end face of the water-dividing disc. The driver is mounted on the water-dividing disc. An end face of the driver is formed with second bevel teeth to mate with the first bevel teeth. The center of the driver is formed with a beveled groove. An end of the worm is formed with a beveled reinforcing fillet which is inserted in the beveled groove of the driver to mate with the driver. Another end of the worm is a stopping part extending out of the switching hole of the switching space. The separation spring is disposed between the driver and the worm. An end of the positioning pin is pivoted in the switching space. Another end of the positioning pin is a pawl to mate with the ratchet. The push button corresponds to the switching hole and the stopping part of the worm, and is mounted outside the switching space. A sealing member is provided between the components Preferably, the worm is formed with an axial guide rib thereon. The switching space is formed with a guide groove. By the axial guide rib to mate with the guide groove, the worm is assembled in the switching space to be moved axially.

Preferably, the first bevel teeth and the second bevel teeth are offset to one side thereof, so that one side of the bevel teeth has a large inclination and another side has a small inclination.

Preferably, a sealing ring is provided between the inner wall of the switching space close to the water inlet and the end face of the water-dividing disc.

Preferably, a sealing washer is provided between the stopping part of the worm and the switching hole.

Preferably, the switching hole is further provided with a small cover, the small cover is configured to cover the stopping part of the worm, and the small cover is located at an inner inside of the push button.

Preferably, a press spring is provided between the switching space and the driver. The press spring and the separation spring are located at two sides of the driver, respectively.

When in use, the push button is pressed to push the worm. The worm brings the driver to rotate and further to bring the water-dividing disc to rotate for changing the water route to switch the spray mode. The pawl of the positioning pin mates with the ratchet of the water-dividing disc to effect the positioning of the water-dividing disc so as to complete the change of the water route.

The switching structure of the present invention is simple and compact, with one push button to control multiple spray modes. The switching operation is more convenient, and the function is more stable.

Embodiments of the present invention will now be described, by way of example only, with reference to the accompanying drawings.

DETAILED DESCRIPTION OF THE PREFERRED EMBODIMENTS

Figure 1:
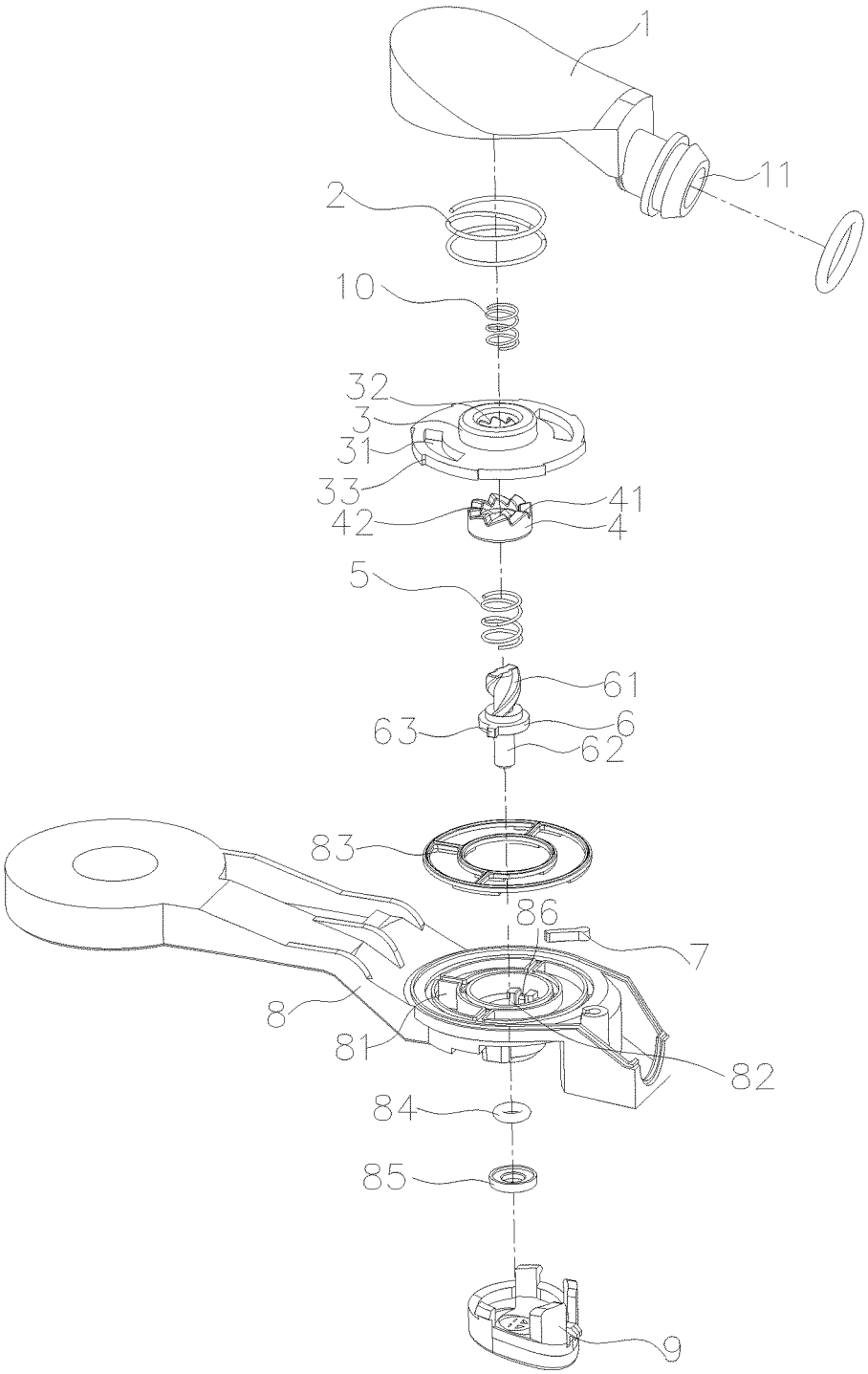
FIG. 1 is an exploded view of the present invention.
Figure 2:
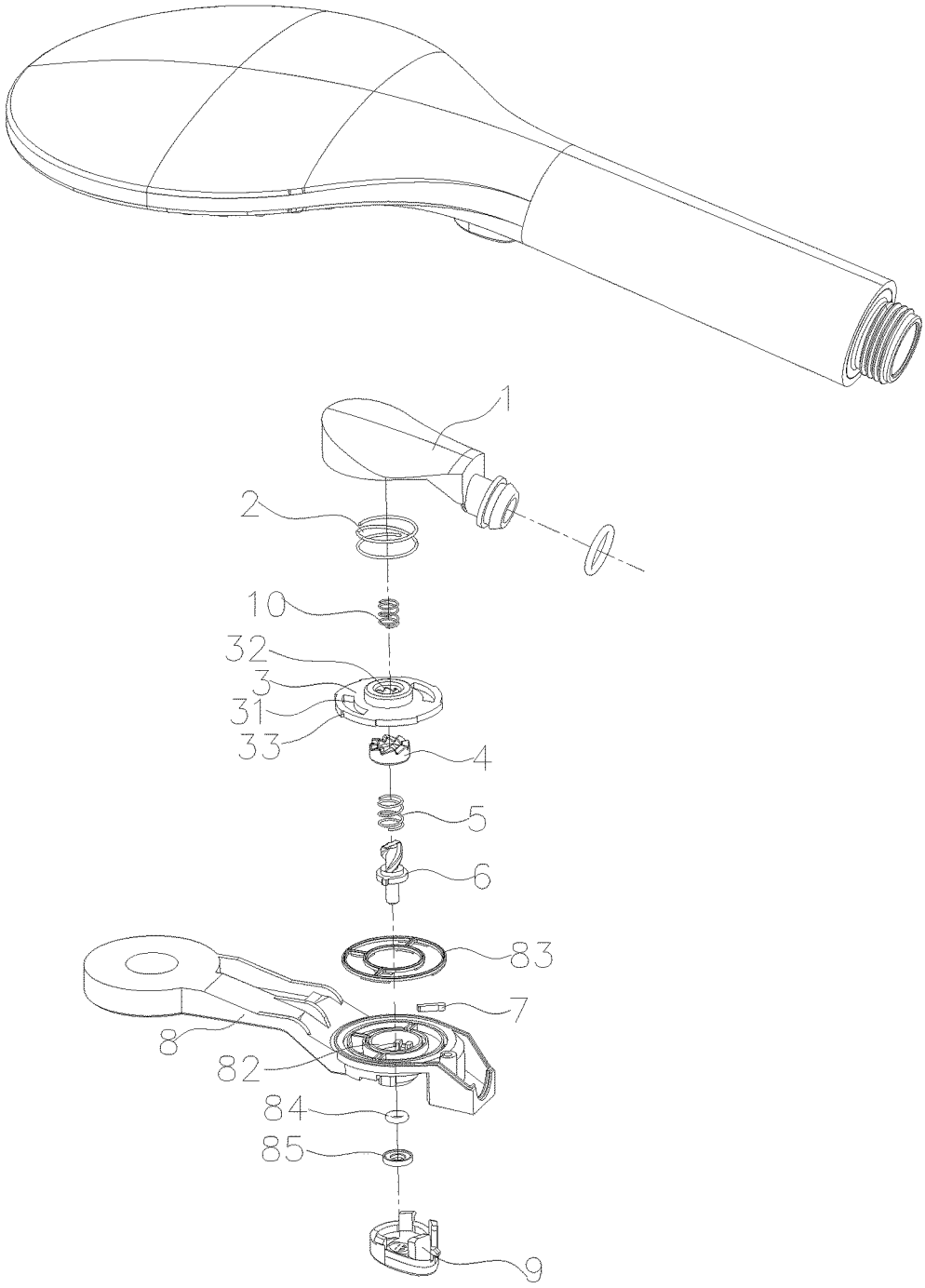
FIG. 2 is an exploded view of the present invention applied to a hand-held shower head.
Figure 3:
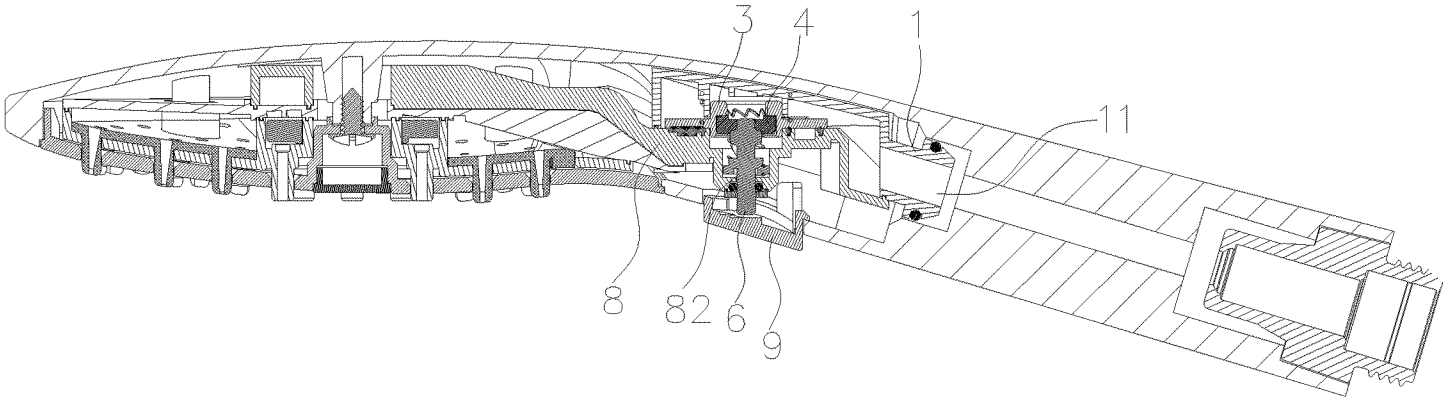
FIG. 3 is a sectional view of the present invention applied to a hand-held shower head.
Figure 4:
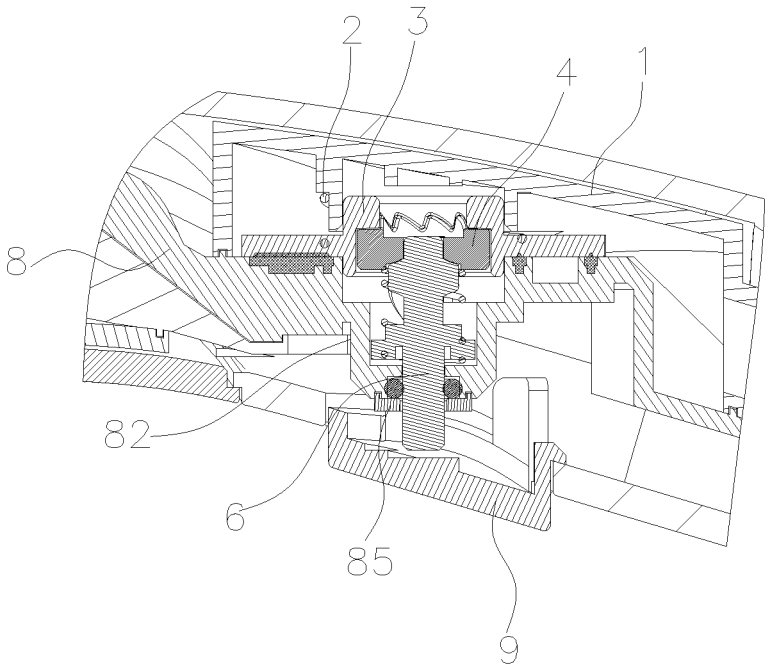
FIG. 4 is a partially enlarged view of FIG. 3.
Figure 5:
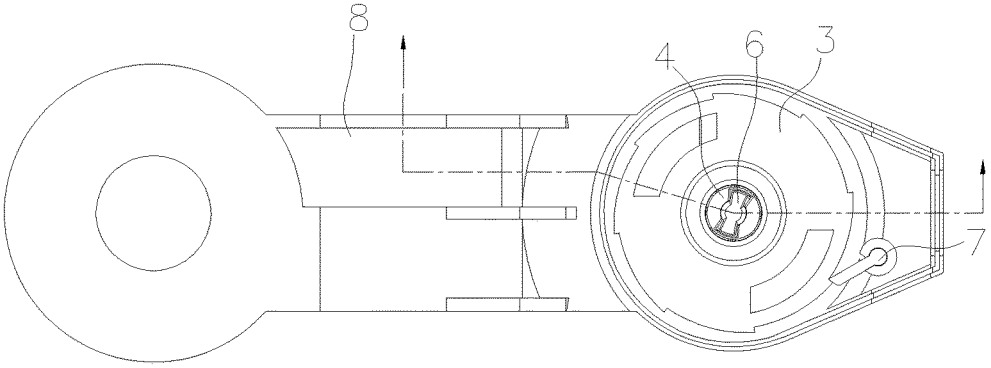
FIG. 5 is a partial top view of the present invention.
Figure 6:
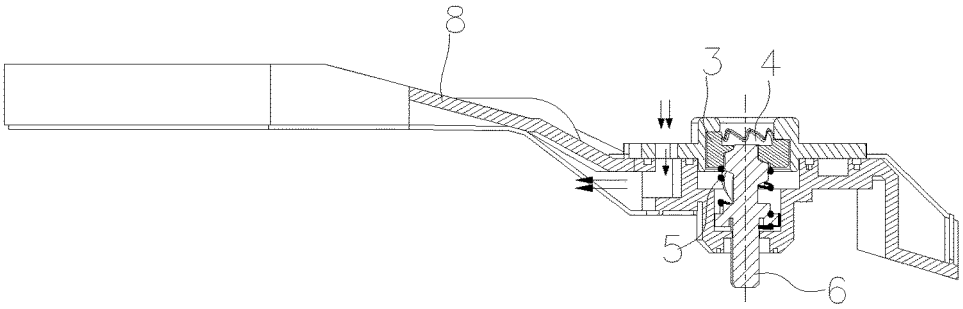
FIG. 6 is a partial top view of the present invention.

FIG. 1 through FIG. 6 shows a preferred embodiment of the present invention. A push-button switching structure for a hand-held shower head comprises a water route upper cover 1, a pre-compressed spring 2, a water-dividing disc 3, a driver 4, a separation spring 5, a worm 6, a positioning pin 7, a water route lower cover 8, and a push button 9.

The water route upper cover 1 and the water route lower cover 8 are fastened together to form a switching space. The switching space is formed with a water inlet 11 and a multi-sectioned water outlet 81 and a switching hole 82.

The water-dividing disc 3 is mounted between the water inlet 11 and the multi-sectioned water outlet 81 in the switching space. The water-dividing disc 3 is formed with a multi-sectioned water dividing hole 31 corresponding to the multi-sectioned water outlet 81. The center of the water-dividing disc 3 is formed with first bevel teeth 32. The edge of the water-dividing disc 3 is formed with a ratchet 33.

The pre-compressed spring 2 is disposed between an inner wall of the switching space close to the water inlet 11 and an end face of the water-dividing disc 3.

The driver 4 is mounted on the water-dividing disc 3. An end face of the driver 4 is formed with second bevel teeth 41 to mate with the first bevel teeth 32 for transmission. The center of the driver 4 is formed with a beveled groove 42. The first bevel teeth 32 and the second bevel teeth 41 are offset to one side so that one side of the bevel teeth has a large inclination and the other side has a small inclination. Its structure is similar to the switching gear of a two-color or multi-color ballpoint pen.

An end of the worm 6 is formed with a beveled reinforcing fillet 61 which is inserted in the beveled groove 42 of the driver 4 to mate with the driver 4 for transmission. Another end of the worm 6 is a stopping part 62 extending out of the switching hole 82 of the switching space. For the worm 6 to drive precisely, the worm 6 is formed with an axial guide rib 63 thereon. The switching space is formed with a guide groove 86. By the axial guide rib 63 to mate with the guide groove 86, the worm 6 is assembled in the switching space to be moved axially.

The separation spring 5 is disposed between the driver 4 and the worm 6. When the worm 6 is not pressed, the separation spring 5 lifts the worm 6. For controlling the worm 6 more precisely, a press spring 10 is provided between the switching space and the driver 4. The press spring 10 and the separation spring 5 are located at two sides of the driver 4, respectively.

An end of the positioning pin 7 is pivoted in the switching space. Another end of the positioning pin 7 is a pawl to mate with the ratchet 33.

The push button 9 corresponds to the switching hole 82 and the stopping part 62 of the worm 6, and is mounted outside the switching space.

A sealing member is provided between the aforesaid components, achieving a watertight function. For example, a sealing ring 83 is provided between the inner wall of the switching space close to the water inlet 11 and the end face of the water-dividing disc 3. A sealing washer 84 is provided between the stopping part 62 of the worm 6 and the switching hole 82. The switching hole 82 is further provided with a small cover 85. The small cover 85 is configured to cover the stopping part 62 of the worm 6. The small cover 85 is located at an inner inside of the push button 9.

Figure 7:
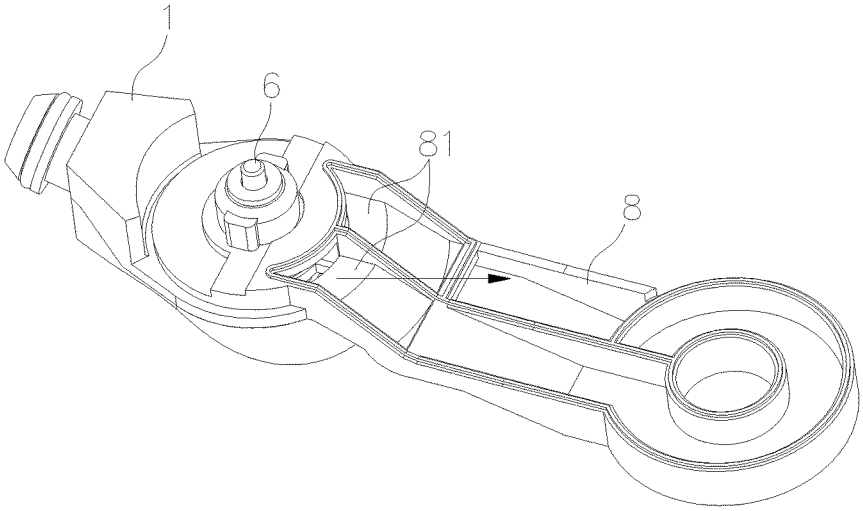
FIG. 7 is a bottom perspective view of the present invention in a first spray state.
Figure 8:
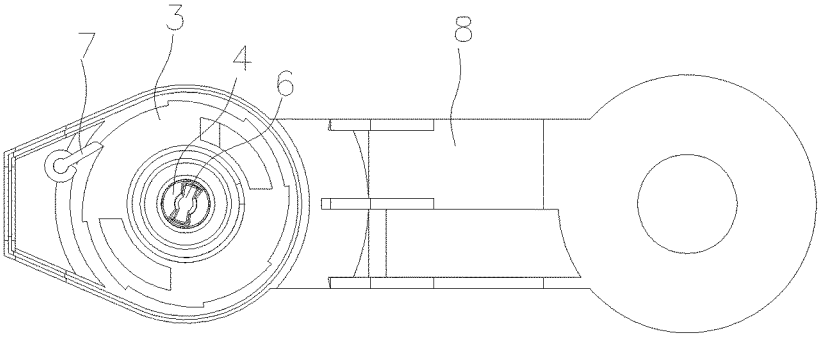
FIG. 8 is a top planner view of the present invention in the first spray state.
Figure 9:
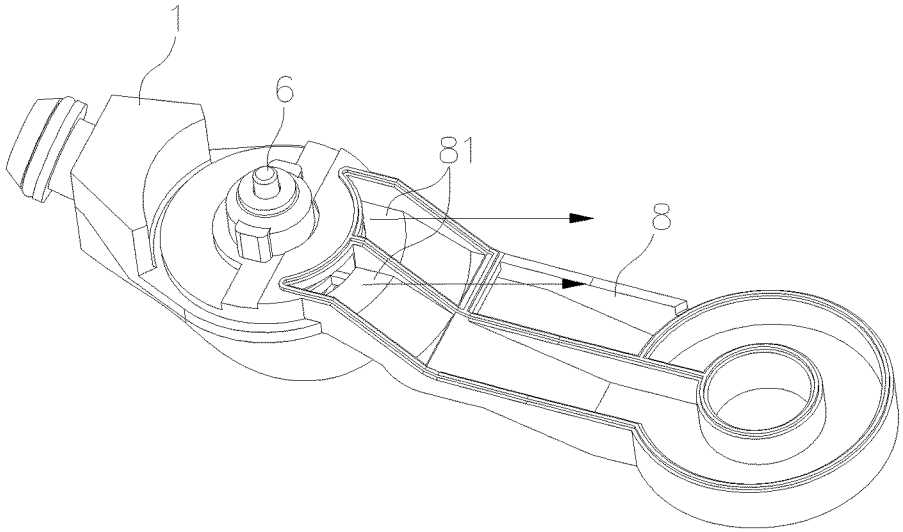
FIG. 9 is a bottom perspective view of the present invention in a second spray state.
Figure 10:
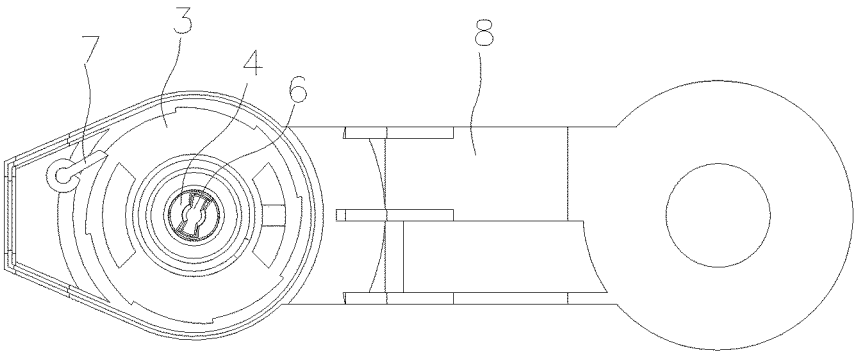
FIG. 10 is a top planner view of the present invention in the second spray state.
Figure 11:
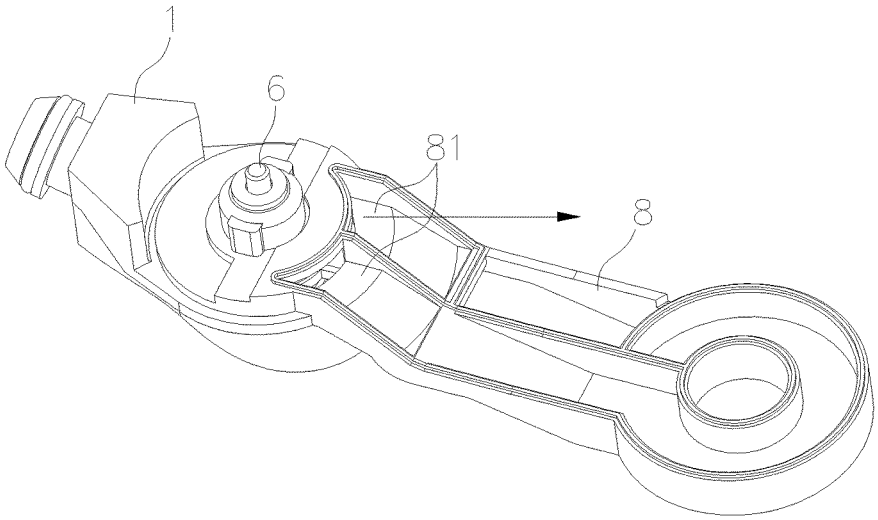
FIG. 11 is a bottom perspective view of the present invention in a third spray state.
Figure 12:
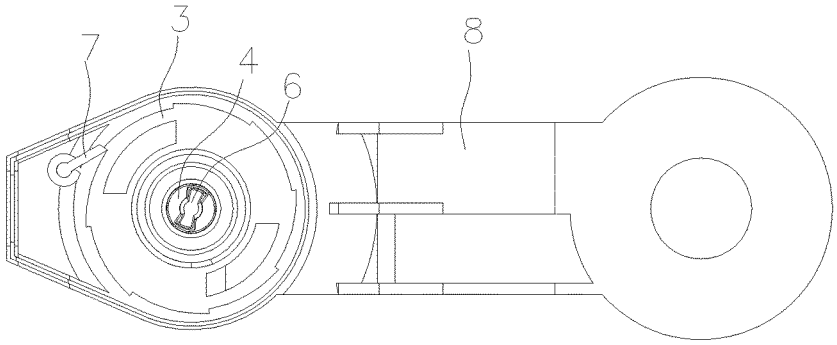
FIG. 12 is a top planner view of the present invention in the third spray state.
Figure 13:
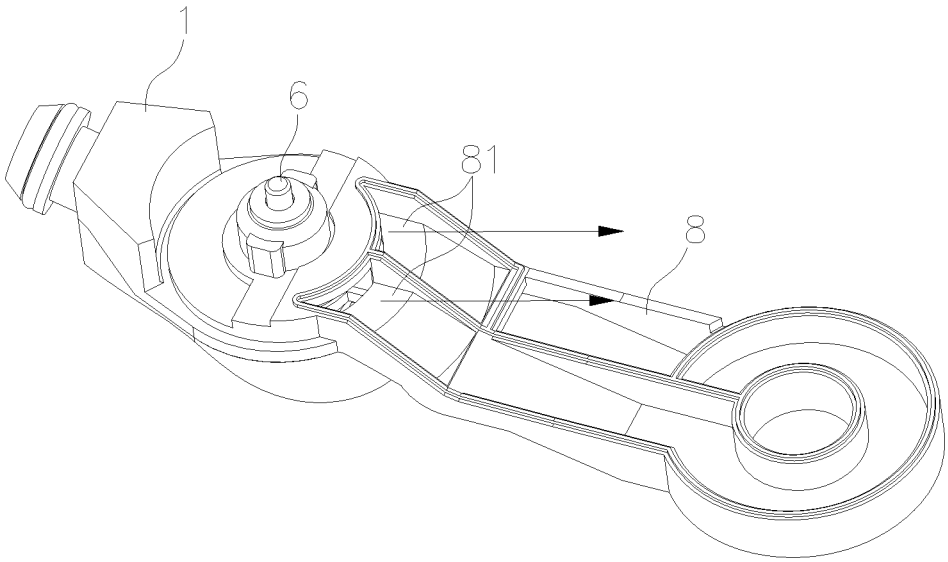
FIG. 13 is a bottom perspective view of the present invention in a fourth spray state.
Figure 14:
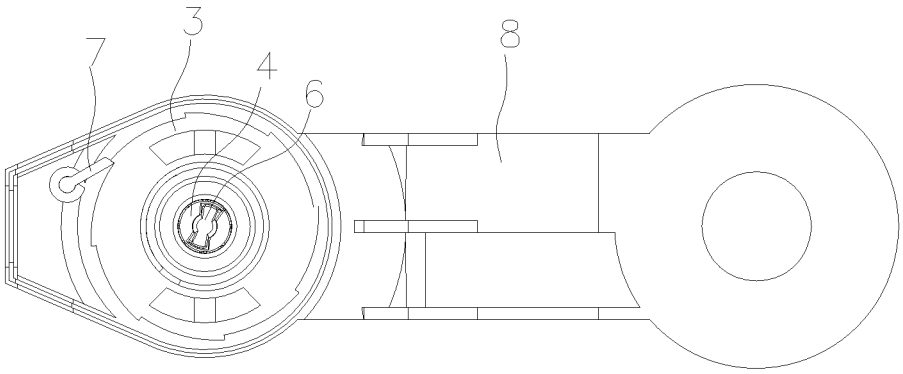
FIG. 14 is a top planner view of the present invention in the fourth spray state.

When in use, the push button 9 is pressed to push the worm 6 downward. By the axial guide rib 63 to mate with the guide groove 86, the worm 6 is moved linearly along the axis to make the movement of the worm 6 more precise. The beveled reinforcing fillet 61 of the worm 6 mates with the beveled groove 42 of the driver 4 to bring the driver 4 to rotate. The first bevel teeth 32 mate with the second bevel teeth 41 to bring the water-dividing disc 3 to rotate. The multi-sectioned water dividing hole 31 of the water-diving disc 3 is communicated with the multi-sectioned water outlet 81, referring to FIG. 7 to FIG. 14, such that the water route can be changed to switch the spray mode. The rotation angle of the water-dividing disc 3 is controlled by the stroke of the worm 6.

When the push button 9 is released, the separation spring 5 (or in cooperation with the press spring 10) pushes the worm 6 in the opposite direction to the initial position, while the driver 4 is rotated to the next meshing position. The water-dividing disc 3 is also rotated back. The pawl of the positioning pin 7 mates with the ratchet 33 of the water-dividing disc 3 to effect the positioning of the water-dividing disc 3 so as to complete the change of the water route. The water-dividing disc 3 is biased by the pre-compressed spring 2, in cooperation with the sealing ring 83, to provide an effect of sealing the water route. Specifically, when the water-dividing disc 3 rotates, the pre-compressed spring 2 (i.e. a spring in a pre-compressed state) may slowly restore, during which the pre-compressed spring 2 would act on the water-dividing disc 3, and thereby act on the sealing ring 83, so that the sealing ring 83 may be tightly pressed to seal the water route, thus finally achieving the effect of sealing the water rout.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A push-button switching structure for a hand-held shower head, comprising a water route upper cover, a pre-compressed spring, a water-dividing disc, a driver, a separation spring, a worm, a positioning pin, a water route lower cover, and a push button; the water route upper cover and the water route lower cover being fastened together to form a switching space, the switching space being formed with a water inlet and a multi-sectioned water outlet and a switching hole; the water-dividing disc being mounted between the water inlet and the multi-sectioned water outlet in the switching space, the water-dividing disc being formed with a multi-sectioned water dividing hole corresponding to the multi-sectioned water outlet, a center of the water-dividing disc being formed with first bevel teeth, an edge of the water-dividing disc being formed with a ratchet the pre-compressed spring being disposed between a lower side of the water route upper cover and an end face of the water-dividing disc in the switching space; the driver being mounted on the water-dividing disc, an end face of the driver being formed with second bevel teeth to mate with the first bevel teeth, a center of the driver being formed with a beveled groove; an end of the worm being formed with a beveled reinforcing fillet inserted in the beveled groove of the driver to mate with the driver, another end of the worm being a stopping part extending out of the switching hole of the switching space; the separation spring being disposed between the driver and the worm; an end of the positioning pin being pivoted in the switching space, another end of the positioning pin being a pawl to mate with the ratchet; the push button corresponding to the switching hole and the stopping part of the worm and being mounted outside the switching space; sealing members being provided among the water route upper cover, the water-dividing disc, the worm and the water route lower cover, the switching hole is further provided with a small cover, the small cover is configured to cover the stopping part of the worm, and the small cover is located at an inner inside of the push button.

2. The push-button switching structure for a hand-held shower head as claimed in claim 1, wherein a press spring is provided between the water route upper cover and the driver in the switching space, and the press spring and the separation spring are located at two sides of the driver, respectively.

3. The push-button switching structure for a hand-held shower head as claimed in claim 1, wherein the worm is formed with an axial guide rib thereon, a guide groove is formed in the water route lower cover, and by the axial guide rib to mate with the guide groove, the worm is assembled in the switching space to be moved axially.

4. The push-button switching structure for a hand-held shower head as claimed in claim 1, wherein the first bevel teeth and the second bevel teeth are offset to one side thereof, so that one side of the bevel teeth has a large inclination and another side has a small inclination.

5. The push-button switching structure for a hand-held shower head as claimed in claim 1, wherein a sealing ring is provided between an upper side of the water route lower cover and the end face of the water-dividing disc in the switching space.

6. The push-button switching structure for a hand-held shower head as claimed in claim 1, wherein a sealing washer is provided between the stopping part of the worm and the switching hole.

* * * * *